United States Patent [19]

Rubin

[11] 4,049,467

[45] Sept. 20, 1977

[54] METHOD AND COMPOSITIONS FOR REMOVAL OF HARD SURFACE MANGANESE ION-DERIVED DISCOLORATIONS

[75] Inventor: Fred Kurt Rubin, Leonia, N.J.

[73] Assignee: Lever Brothers Company, New York, N.Y.

[21] Appl. No.: 679,521

[22] Filed: Apr. 23, 1976

[51] Int. Cl.[2] ..... B08B 3/08; C02B 5/06

[52] U.S. Cl. ..... 134/2; 134/3; 252/82; 252/86; 252/87; 252/89 R; 252/132; 252/135; 252/136

[58] Field of Search ..... 134/2, 3, 7; 252/82, 252/86, 87, 89, 105, 132, 135, 140, 180, 181, 136, 99

[56] References Cited

U.S. PATENT DOCUMENTS

| | | | |
|---|---|---|---|
| 3,281,367 | 10/1966 | Jones et al. | 252/140 X |
| 3,303,104 | 2/1967 | Rubin | 252/99 |
| 3,526,545 | 9/1970 | Abowd | 134/3 |
| 3,554,801 | 1/1971 | Kleimán | 134/3 |
| 3,630,929 | 12/1971 | Dijk | 252/136 |
| 3,776,851 | 12/1973 | Cheng | 252/89 |
| 3,979,314 | 9/1976 | Child | 252/135 X |

*Primary Examiner*—S. Leon Bashore
*Assistant Examiner*—Marc L. Caroff
*Attorney, Agent, or Firm*—Michael J. Kelly; Melvin H. Kurtz; James J. Farrell

[57] ABSTRACT

Manganese ion-derived discolorations are removed from hard surfaces by the use of either dihydroxy maleic acid, dihydroxy tartaric acid, their alkali metal salts, or mixtures thereof.

The non-toxicity and non-corrosivity of the disclosed compounds make them particularly suitable for household applications.

26 Claims, No Drawings

METHOD AND COMPOSITIONS FOR REMOVAL OF HARD SURFACE MANGANESE ION-DERIVED DISCOLORATIONS

BACKGROUND OF THE INVENTION

This invention relates to methods and compositions suitable for removing the discolorations on hard surfaces caused by water borne manganese ions. These dicolorations are particularly evident on hard surfaces associated in automatic dishwashing when detergent compositions containing chlorinating compounds are used in conjunction with water containing manganese ions.

Detergent compositions containing chlorinating compounds are now widely used for many cleansing applications. It has been observed for some time that metallic surfaces such as gold, silver, platinum and certain nonmetallic surfaces including chinaware, glass, porcelain and plastic, and those surfaces such as are found inside automatic dishwashing machines and other similar household appliances become discolored when contacted with detergent formulations containing chlorinating agents in the presence of manganese ions. Additionally, the same manganese ion discoloration has been found to occur on the surfaces of swimming pools when certain oxidizing agents, as previously discussed, are employed for treating the pool water. This discoloration is particularly noticed when the aforementioned elements are brought together at elevated temperatures as those usually associated with washing appliances. Since the water of many communities contains sufficient concentrations of manganese ions to cause discoloration of hard surfaces, it is apparent that a serious problem exists in this regard.

The discoloration, previously referred to, occurs usually in the presence of manganese ions when halogenating or other oxidizing compounds are present. The rate at which the discoloration appears is associated with the relative amounts of manganese ion and oxidizing compound present. The staining is particularly rapid when the oxidizing agent is present at the levels associated with the use of a commercial chlorinated dishwasher product.

The followng halogenating compounds have been found to induce discoloration: sodium and potassium dichloroisocyanurate, dichloroisocyanuric acid, trichloroisocyanuric acid, dichlorodimethylhydantoin, N,N-dichlorop-toluene-sulfonamide, sodium chlorite and chlorine. These compounds, in the presence of manganese in bearing water, will cause discoloration when used alone or when incorporated into detergent compositions. Elemental bromine has also been found to cause discoloration of hard surfaces in like manner.

While the aforementioned compounds are all nonalkaline halogenating agents, it should not be inferred that the discoloration will not occur in the presence of alkaline chlorinating agents. To the contrary it has been found that the discoloration is also caused when alkaline chlorinating compounds are present along with the water borne manganese ions. Typical examples of these compounds include: calcium and sodium hypochlorite and chlorinated trisodium phosphate.

While the aforementioned examples produce the characteristic stain under the previously outlined conditions, it is not to be implied that the discoloration will occur only with these particular agents. In actuality, the discoloration of the hard surface will occur with any agent sufficiently strong to oxidize manganese ions. What should be noted, however, is that both elements; the manganese ions and the oxidizing agent must be present. Thus when either manganese ions or the oxidizing materials are removed, it is observed that no discoloration occurs.

The State of the Art

The art in this area has dealt primarily with inhibiting or preventing the discoloration rather than the ex post facto removal of the the same.

There is disclosed in the art the use of gluconate ions to inhibit discoloration. Rubin, U.S. Pat. No. 3,303,104. This reference, however, is limited to the prevention of discoloration and does not deal with the removal of such discoloration once formed.

There has also been disclosed the use of acids as either rinse aids or solubilizers in detergent compositions. Wedell, U.S. Pat. No. 3,481,881. van Dyk, U.S. Pat. No. 3,630,929. Again, however, this reference is not directed to the object of the instant invention.

It has also been disclosed that certain acids can under certain conditions remove manganese ion deposits. Hnizda, U.S. Pat. No. 3,682,702. However, the acids disclosed must fall within specific formula constraints and be of specific ionization potential to be effective.

The use of tetrahydroxysuccinic acid and the salts thereof for the purpose of replacing phosphate builders has been disclosed. Cheng, U.s. Pat. No. 3,776,851. However, this disclosure is severely limited to the incorporation of the compound as a detergent builder. Moreover, the compositions disclosed are limited to those producing in situ pH values of greater than 8.5 to provide utility. In addition, there is clear indication of lack of utility as builders for those particular salt compounds that interfere with chelation.

It has been disclosed that L-ascorbic acid is effective in removing incrustations containing iron and manganese deposits from the walls of drinking water tanks. German Auslegeschrift No. 2040546. It is not apparent from this disclosure if the deposits so treated are analogeous to the type of discoloration of the instant invention. Moreover, the use of L-ascorbic acid is not predictive of the results obtained by the compounds of the instant invention due to the structual and chemical dissimilarity of L-ascorbic acid and applicant's compounds.

While the art does provide various different solutions to the manganese staining problem, they have many disadvantages, among them being toxicity, corrosivity and incompatibility in formulation.

SUMMARY OF THE INVENTION

An object of the instant invention is the removal of manganese-ion derived discolorations from hard surfaces by the use of certain polyhydroxycarboxylic acids, the alkali metal salts of those acids and mixtures thereof. The aforementioned acids of the general formula:

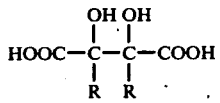

wherein both R groups are either hydroxy or are absent. In the case where the R groups are absent, a double bond is formed between the two hydroxy carbons. Specific examples of such acids are dihydroxymaleic acid and dihydroxytartaric acid.

A further object of the invention is to accomplish the discoloration removal by use of either a hard surface cleaning composition or a scouring powder composition, the active systems of which comprises the certain polyhydroxycarboxylic acids disclosed above as well as the alkali metal salts of those acids and mixtures thereof. By "hard surface cleaning composition" is meant a substantially non-abrasive composition primarily intended to remove manganese discolorations which are formed on dishes, eating and serving utensils, dishwashing or laundry washing machine interiors and other hard surfaces.

A still further object of the invention is to accomplish said removal by the use of a composition which is both non-toxic and substantially non-corrosive.

Yet another object of this invention is the use of the aforementioned acids, their various alkali metal salts and mixtures thereof as components of a dishwasher rinse agent.

In a search for discoloration removing agents applicant has found several chemicals which remove manganese discoloration very effectively. These compounds, however, are unsuitable for use around the house due to their toxicities or corrosivity to both the user and the intended appliances. Various examples of these unsuitable compounds include oxalic acid, formic acid, hydroxylamine hydrochloride, sodium metabisulfite an sodium hydrosulfite.

Applicant has now discovered that certain polyhydroxycarboxylic acids, the alkali metal salts of these acids and mixtures thereof when used alone or in various compositions, provide a non-toxic, non-corrosive and highly effective means for the removal of discolorations caused by water born manganese compounds. As previously stated, the specific aforementioned acids are of the general formula:

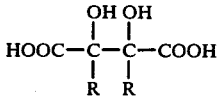

wherein both R groups are simultaneously either hydroxy or are absent. In the case where the R groups are absent, a double bond is formed between the adjacent hydroxy carbons. Specific examples of such acids are dihydroxymaleic acid;

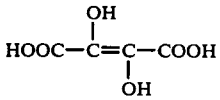

and dihydroxytartaric acid;

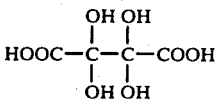

As can be noted in the previous structures only one structual isomer of dihydroxymaleic acid is shown. This form is the trans configuration. As is well known in the art, only this single isomer of dihydroxymaleic has been shown to exist. This is also known in the chemical art as dihydroxyfumaric acid.

As stated above, it has also be discovered that the salts of the aforementioned acids as well as mixtures of the various salts and acids are effective means for discoloration removal. These salts are of the general formula:

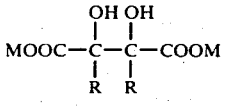

wherein R is as previously described and wherein at least one M per molecule is an alkali metal and in the case where only one M on a particular molecule is an alkali metal the remaining M is hydrogen. As is well known, the actual degree of substitution of alkali metal salt in final use formula will be dependent upon the pH of that formula.

Hereinafter, for the purpose of brevity and ease of reading the polyhyroxycarboxyic acids, the alkali metal salts of those acids and mixtures thereof, will be collectively referred to as the "hydroxy compounds". Reference to either the acid form or salt forms of the polyhydroxycarboxylic acids wil be made as the "hydroxy acids" or "hydroxy salts", respectively.

The mechanism by which the hydroxy compounds of the instant invention remove manganese discolorations is not precisely known. Discoloration is not a function of acidity nor does it appear to be solely the result of manganese chelation. Although not wishing to be bound by the following statement it is theorized that irreversible reduction of colored manganese oxidation compounds by the hydroxy compounds is a prime factor in discoloration removal.

Applicant has examined other non-toxic, non-corrosive acids such as citric, gluconic and tartaric acids and has found them considerably less efffective than the hydroxy compounds of this invention as evidenced by both the speed and degree of tarnish removal. Additionally, the alkali metal salts of citric, gluconic and tartaric acids are completely ineffective in the removal of manganese induced hard surface discoloration in contrast to the hydroxy salts of the instant invention which are highly effective.

The most efficient method of removing discoloration from dishes or machine interiors is by means of a separate treatment with the hydroxy compounds without the presence of a dishwasher detergent, because commercial dishwasher detergents generally contain a chlorinating agent which would be inactivated by their presence.

While the hydroxy compounds may be added directly to the dishwashing machine or other appliance, it is preferable to add them in a less concentrated form, such as a component of a dishwasher hard surface discoloration removing rinse agent, e.g. in a powder, diluted with a inert material such as sodium sulfate, as a tablet or pellet or in the form of an aqueous solution. For the purpose of simplification, these type compositions will be referred to collectively as "rinse agents." In such instances, it is convenient and helpful to combine various known surfactants and related compounds into such rinse agents to facilitate the flushing and carrying away of residues as well as the enhancement of the wetting of the hard surfaces.

Removal of manganese induced discolorations by the hydroxy compounds is not limited to automatic dishwashing, but extends to all area where manganese derived discolorations or tarnishes can be found and are objectionable. Thus, it was found that brown bathtub stains can readily be removed by treating the same with the hydroxy compounds of the instant invention. Further, the instant invention is not limited to household appliances, but has broad application to any commercial or industrial situation where such discolorations are encountered. These applications include, but are not limited to, any metallic finishing or preparation procedure such as jewelry manufacture or electrical component finishing, glass and enamel manufacture and finishing and other such applications where such discolorations are found.

As stated above, the hydroxy compounds of the instant invention may be utilized as an essential component of either a hard surface cleaning composition, a scouring powder or as various other forms of a dishwasher or appliance rinse agent.

With respect to an aqueous rinse product, any amount including a simple slurry of the hydroxy compounds in water is functional. However, with aqueous applications it is preferred to employ a homogenous product, therefore a surry is not referred, and lesser concentrations of the compounds in solution should be employed. Accordingly,, the amount of hydroxy compounds in such an application preferably ranges from about 0.001% to the limit of solubility of the particular hydroxy compound being employed. This limit of solubility will, of course, be affected by the presence of other adjuvants. Additionally, when such a rinse agent is meant, in use, to be further diluted, the range of hydroxy compound should be such to provide a concentration of about 0.001% to 0.5% in final dilution. In such cases, the hydroxy compound in such rinse agent should preferably be in the range of about 0.3% to about 16% of the total composition. A preferred range in final dilution is from about 0.005% to about 0.5% with the most preferable range in final dilution being from about 0.05% to about 0.5%. One skilled in the art knowning the particular applications, i.e. capacity of the appliance being treated and mode of treatment (e.g. the water capacity of a dishwasher and the size of the product dispenser) can determine the particular concentrations required in the rinse aid.

Additionally, liquid hard surface discoloration removing compositions can be in the form of a liquid scouring composition including various other components such as alkali metal hydroxides for the control of pH, colorants, perfumes and abrasives such as silica, kaoline, calcite, dolomite, pumice stone, scoria, feldspar, ground marble and other ground rock as well as other abrasives well known in the art and mixtures of these various abrasives. Includeable also are such things as surfactants, present in the liquid scouring composition at a level of about 0.5% to about 20%, and builders. Surfactants that may be employed include, but are not limited to, alkylsulfates where preferably the alkyl chain varies from 8 to 18 carbons in length; alkylbenzene sulfonates where preferably the alkyl moiety varies from 8 to 18 carbons in length; ethoxylated alkylsulfates where preferably the alkyl moiety is from 8 to 18 carbon atoms in length and where preferably the degree of ethylene oxide (EO) substitution ranges from one to ten moles of EO per molecule; sulfonated ethoxylated alkyl phenols where preferably the alkyl moiety varies from 6 to 16 carbon atoms in length and where preferably the EO substitution ranges from one to fifteen moles of EO per molecule; sulfated fatty esters of acids or alcohols where preferably the chain length of the acids vary from 7 18 carbon atoms and the chain length for the alcohols varies from 7 to 18 carbons in length; α-olefin sulfonates, alkyl sulfosuccinates were preferably the alkyl moiety varies from 8 to 18 carbon atoms in length; N-methyl taurides; alkyl monoethanolamides where the alkyl moiety preferably varies from 8 to 18 carbons in length, alkyl diethanolamides where the alkyl moiety preferably varies from 8 to 18 carbons in length, glycerolamides, tris-(hydroxy methyl)-methylamides and amine oxides where preferably the alkyl chains vary from 8 to 18 carbon atoms, as well as the sodium, potassium, lithium or ammonium fatty acid soaps where preferably the alkyl chain of the soaps varies from 7 to 22 carbons in length. Builders may be employed to provide improved detergency when such surfactants are also employed. These builders include; but are not limited to, alkali metal salts of orthophosphates, polyphosphates, carbonates, borates, ethylene diaminetetraacetic acid, nitrilotriacetic acid and citric acid. The last three mentioned acids may also be used in the acid or various alkali metal salt forms. Also contemplated is the use of carboxymethyloxysuccinate (CMOS) and carboxymethyloxytartronate. The builders may be present at levels of about 2% to about 40% of the composition. Preferably they are present at about 10% to about 20% of the composition. It is highly desirable for the purpose of homogeneity and appearance to have liquid scouring compositions be substantially stable. When abrasives such as those described above are used in the composition described above, it is not uncommon to have the abrasives settle out, sometimes quite rapidly. Substantially stable, pourable suspensions of finely-divided water-insoluble abrasive material can be fabricated comprising water, an anionic surface active agent and a nonionic surface active agent. Preferably these component will also contain a fatty acid alkanolamide. A complete description of these suspensions will be found in Jones U.S. Pat. No. 3,281,367 Oct. 25, 1966 and incorporated herein by reference.

Likewise, in powdered hard surface cleaning compositions, ranges of concentration can best be determined by the final dilution use concentrations previously disclosed. For practical purposes, ranges of hydroxy compounds of about 0.5% to about 20% achieve final dilution levels in use within the ranges previously disclosed. The preferred range for these compositions will be from about 10% to about 18% and generally the most preferred level of the hydroxy compounds is about 16% of the powdered composition. Again, as with the aqueous rinse aid, the most practical concentrations for particular purposes can readily be determined by one skilled in the art.

It has also been found that the hydroxy compounds at concentrations of about 1% to about 10% in scouring powders removes tarnishes and discolorations excellently. A preferred range in products of this type ranges in concentrations of about 4% to about 8%. Again the most practical concentrations for a given application can be determined by one skilled in the art.

Typical powdered hard surface discoloration removing compositions will include such things as fillers selected from the group including sodium sulfate, sodium chloride, soda ash, sodium bicarbonate, sodium diacetate, sodium sesquicarbonate, sodium borates, sodium silicates, sodium phosphates, sodium acetate, as well as colorants, perfumes and optionally surfactants such as compounds containing an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used, there may be noted the condensation products of alkyl phenols with ethylene oxide, e.g., the reaction product of one mole of isooctyl phenol with about 6 to 30 moles of ethylene oxide; condensation products of higher fatty alcohols with ethylene oxide such as the reaction product of one mole of tetradecyl alcohol with eleven moles of ethylene oxide, monoesters of hexahydric alcohols and inner ethers thereof such as sorbitan monolaurate, sorbitan mono-oleate and the condensation products of these esters with ethylene oxide and mannitan monopalmitate, and the condensation products of polypropylene glycol with ethylene oxide as wetting agents. While nonionic surfactants are preferred, the use of anionic and cationic surfactants are not excluded. As a matter of fact, other nonionics as well as suitable anionics and cations are disclosed in Schwartz and Perry, "Surface Active Agents", Vols. I and II (1949 and 1958, respectively).

These compositions may be utilized also in the preparation of tarnish removing tablets by incorporating a binder such as starch, polyvinyl alcohol, carbowaxes, etc. all of which are well known to the art.

Most scouring powders contain either soap or a surfactant with a builder and an abrasive. The surfactants are present in the scouring powder compositions at a level of about 0.5% to about 15% and may be selected from a wide range of materials such as anionic detergents. Among these may be cited the higher alkyl mononuclear aromatic sulfonates such as the higher alkyl benzenesulfonates containing from 10 to 16 carbon atoms in the alkyl group in a straight or branched chain, e.g., the sodium salts of decyl, undecyl, dodecyl (lauryl), tridecyl, tetradecyl, pentadecyl, or hexadecyl benzenesulfonate and the higher alkyl toluene, xylene and phenolsulfonates; alkyl naphthalenesulfonate, ammonium diamyl naphthalenesulfonate and sodium dinonylnaphthalenesulfonate.

Other anionic detergents are the olefin sulfonates, including long chain alkenesulfonates, long chain hydroxyalkanesulfonates or mixtures of alkenesulfonates and hydroxyalkanesulfonates. These olefin sulfonate detergents may be prepared, in known manner, by the reaction of $SO_3$ with long chain olefins (of 8–25, preferably 12–21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g. sodium bisulfite), e.g. primary paraffin sulfonates of about 10–20, preferably about 15–20, carbon atoms; sulfates or higher alcohols; salts of $\alpha$-sulfofatty esters (e.g. of about 10–20 carbon atoms, such as methyl-$\alpha$-sulfomyristate or $\alpha$-sulfotallowate).

Examples of sulfates or higher alcohols are sodium lauryl sulfate, sodium tallow alcohol sulfate. Turkey red oil or other sulfated oils, or sulfates of mono- or diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) of isothionates and the acyl N-methyl taurides (e.g. potassium N-methyl lauroyl- or oleyl tauride). These detergents may be used at levels of from about 2% to about 5%.

The builders may be selected from the alkali metal salts of orthophosphates, polyphosphates, carbonates, borates, ethylenediaminetetraacetic acid, nitrilotriacetic acid, citric acid. The last three mentioned acids may be used in the acid or alkali metal salt forms. Also contemplated is the use of carboxymethyloxysuccinate (CMOS) and carboxymethyloxytartronate. The builders may be present at levels of from about 3% to about 10%, preferably from about 3% to about 6%.

The abrasives may be selected from powdered silica, pumice stone, scoria, feldspar, calcite, dolomite or ground rock. Minor components such as colorants and perfumes may also be added.

Also, as aforestated, it is to be understood that other alkali metal salts of the hydroxy acids such as the lithium salts are operable in the instant invention.

The invention will be more fully understood by reference to the following Examples, which are presented for illustrative purposes, and are not to be interpreted as limiting the scope of the invention. All parts and proportions are by weight unless specified otherwise.

EXAMPLE 1

Platinum strips* are immersed in a solution containing one part per million (ppm) of $Mn^{++}$ ions (from $MnSO_4 \cdot H_2O$) and 0.3% of a chlorinated automatic dishwasher detergent. The available chlorine content of the solution is approximately 20 ppm. The solution temperature is 140° F. The platinum strips are left in the solution until they have discolored to a uniform deep golden brown resulting from the formation of manganese oxidation compound.

*Platinum strips are a suitable means of replicating the rapid discoloration of metallic ornaments in dinner plates and metal surfaces during dishwashing.

EXAMPLE 2

Tarnished strps as prepared in Example 1 were immersed in solutions of the hydroxy acids at various concentrations at temperatures ranging from about 80 to 130° F. The results of the time and degree of tarnish removal is shown in Table E2.

The data presented in Table E2 shows that the characteristic discoloraton produced on the hard surface of Example 1 can be completely removed even at very low concentrations of the hydroxy acid during relatively brief exposure periods. It can be clearly seen that the times required for discoloration are well within the parameters of dishwasher operation (e.g. 120°–135° F water temperature, 15–20 minute wash cycle).

Table E2

Discoloration Removal By Various Concentrations of the Hydroxy Acids

| Tarnish Removal Agent | % Concentration | Temperature | Degree of Removal | Time Required for Removal |
|---|---|---|---|---|
| Dihydroxymaleic Acid | 1.0 | 134° F | Complete | 2 sec. |

Table E2-continued

| Discoloration Removal By Various Concentrations of the Hydroxy Acids | | | | |
|---|---|---|---|---|
| Tarnish Removal Agent | % Concentration | Temperature | Degree of Removal | Time Required for Removal |
| Dihydroxymaleic Acid | 0.5 | 100° F | Complete | 12 sec. |
| Dihydroxymaleic Acid | 0.5 | 130° F | Complete | 5 sec. |
| Dihydroxymaleic Acid | 0.05 | 80° F | Complete | 75 sec. |
| Dihydroxymaleic Acid | 0.05 | 130° F | Complete | 30 sec. |
| Dihydroxymaleic Acid | 0.005 | 130° F | Complete | 90 sec. |
| Dihydroxymaleic Acid | 0.001 | 130° F | Complete | 8½ min. |
| Dihydroxytartaric Acid | 1.0 | 124° F | Complete | 13 sec. |
| Dihydroxytartaric Acid | 0.5 | 100° F | Complete | 45 sec. |
| Dihydroxytartaric Acid | 0.5 | 130° F | Complete | 20 sec. |
| Dihydroxytartaric Acid | 0.05 | 100° F | Complete | 2 min. |
| Dihydroxytartaric Acid | 0.05 | 130° F | Complete | 38 sec. |
| Dihydroxytartaric Acid | 0.005 | 100° F | Complete | 21 min. |
| Dihydroxytartaric Acid | 0.005 | 130° F | Complete | 8 min. |

EXAMPLE 3

Part A

Platinum strips as prepared in Example 1 were immersed in various solutions of different organic acids at various temperatures comparative to those expected to be found in automatic dishwashers or home hot water systems. The acids tried included citric, gluconic, acetic, kojic and tartaric. The results of the time and degree of removal appear in Table E3a.

The data presented in Table E3a indicates that while citric, gluconic and tartaric acids also remove manganese induced discolorations, they do so only at much higher concentrations and longer times relative to the hydroxy acids of the instant invention. This becomes immediately clear upon comparison of the data of Table E2 with that contained in Table E3a.

The data associated with acetic acid demonstrates that discoloration removal is not a function of acidity alone as this acid is an example of a non-reducing simple organic acid of comparable acidity.

The data associated with kojic acid indicates that sequestering acids are of little effect.

Part B

To further exemplify the difference between the hydroxy acids and other organic acids, tarnished platinum strips as prepared in Example 1 were exposed to a 5% solution of citric acid at 80° F. It was then observed that it required 3 ½ minutes to remove the tarnish discoloration depiste the relatively high concentration of citric acid in solution. This observation further supports the discovery that the hydroxy compounds of the instant invention in contrast with other organic acids remove tarnish discoloration rapidly and at very low use concentrations (Examples 2 and 3A). Should one wish to maintain a true solution, the upper practical use limit of the dihydroxy maleic acid is in the vicinity of 2.0%, in neat solutions at which point solubility difficulties become noticeable. Dihydroxytartaric acid concentrations above about 1.0% in neat solutions similarly lead to solubility difficulties.

While the acids of the instant invention may be used in concentrations up to the limit of their solubility to effect very rapid tarnish removal, there is no need to operate near the upper limit of the concentration range since solutions as dilute as 0.005% and even 0.001% will still remove tarnish effectively and, at the same time, economically.

Table E3a

| Comparative Data for Various Other Acids | | | | |
|---|---|---|---|---|
| Tarnish Removal Agent | Concentration % | Temperature | Degree of Removal | Time to Effect Removal |
| Citric Acid | 0.5 | 80° F | complete | 30 mins. |
| Citric Acid | 0.5 | 130° F | complete | 15 mins. |
| Gluconic Acid | 0.5 | 80° F | practically complete | 35 mins. |
| Gluconic Acid | 0.5 | 130° F | complete | 10 mins. |
| Tartaric Acid | 0.5 | 80° F | about 90% complete | 30 mins. |
| Tartaric Acid | 0.5 | 130° F | about 90% complete | 10 mins. |
| Maleic Acid | 0.5 | 100° F | 10% | 30 mins. |
| Maleic Acid | 0.5 | 130° F | practically complete | 10 mins. |
| Glucuronic Acid | 0.5 | 100° F | 50% | 16 mins. |
| Glucuronic Acid | 0.5 | 130° F | complete | 15 mins. |
| Acetic Acid | 0.5 | 80° F | no removal | 30 mins. |
| Acetic Acid | 0.5 | 130° F | no removal | 30 mins. |
| Kojic Acid (5-hydroxy-2-(hydroxy methyl)-4H-pyran-4-one) | 0.05 | 120° F | no removal | 5 mins. |

EXAMPLE 4

Platinum strips are tarished as described in Example 1. The tarnished strips are immersed in the following solutions as shown in Table E4.

This example illustrates the specificity of the hydroxy salt which, in contrast to the salts of the other acids tested, remove tarnish as effectively as does the free acid form. Sodium perborate, known for its manganese removal tendencies, is included for comparative purposes. As noted in Table E4, sodium perborate is considerably less effective than the hydroxy compounds in their salt form.

Table E4

| Comparative Data for the Hydroxy Salts and the Salts of Various Other Acids | | | | |
|---|---|---|---|---|
| Tarnish Removal Agent | Concentration % | Temperature | Degree of Removal | Time to Effect Removal |
| Dihydroxy maleic acid sodium salt | 0.5 | 100° F | Complete | 16 secs. |

Table E4-continued

| Comparative Data for the Hydroxy Salts and the Salts of Various Other Acids | | | | |
|---|---|---|---|---|
| Tarnish Removal Agent | Concentration % | Temperature | Degree of Removal | Time to Effect Removal |
| Dihydroxy maleic acid sodium salt | 0.5 | 130° F | Complete | 7 secs. |
| Dihydroxy maleic acid sodium salt | 0.005 | 100° F | Complete | 3 mins. |
| Dihydroxy maleic acid sodium salt | 0.005 | 130° F | Complete | 80 secs. |
| Dihydroxy maleic acid sodium salt | 0.001 | 130° F | 70% | 30 mins. |
| Dihydrox tartaric acid sodium salt | 0.5 | 100° F | Complete | 8 mins. |
| Dihydroxy tartaric acid sodium salt | 0.5 | 130° F | Complete | 3 mins. |
| Dihydroxy tartaric acid sodium salt | 0.05 | 130° F | 80% | 30 mins. |
| Potassium gluconate | 0.5 | 80° F | No removal | 30 mins. |
| Potassium gluconate | 0.5 | 135° F | No removal | |
| Sodium glucoheptonate dihydrate | 0.5 | 80° F | No removal | 30 mins. |
| Sodium gluconheptonate dihydrate | 0.5 | 135° F | No removal | 30 mins. |
| Sodium tartrate | 0.5 | 80° F | No removal | 30 mins. |
| Sodium tartrate | 0.5 | 135° F | No removal | 30 mins. |
| Sodium citrate | 0.5 | 80° F | Slight removal (about 5%) | 30 mins. |
| Sodium citrate | 0.5 | 135° F | Slight removal (about 5%) | 30 mins. |
| Sodium maleate | 0.5 | 130° F | About 5% | 30 mins. |
| Sodium perborate | 0.5 | 80° F | 70% | 30 mins. |
| Sodium perborate | 0.5 | 135° F | 85% | 30 mins. |

EXAMPLE 5

This example illustrates the use of dihydroxy maleic acid in a discoloration removing compositon suitable for dispensing from an automatic dishwasher. The compositions shown below are intended to be used alone, without the presence of a detergent product, whenever it becomes necessary to remove discolorations from dishes or machine interior.

To illustrate discoloration removal by the compositions listed, platinum strips are employed, discolored by the procedure described in Example 1.

The discolored strips are immersed in 0.3% solutions of the following compositions:

| | Powdered Compositions | | |
|---|---|---|---|
| | A % | B % | C % |
| Dihydroxy maleic acid | 16.0 | 16.0 | 16.0 |
| Sodium sulfate | 84.0 | — | — |
| Soda ash | — | 84.0 | — |
| Sodium diacetate | — | — | 84.0 |
| | 100.0 | 100.0 | 100.0 |
| pH (0.3% solution) | 3.4 | 10.3 | 4.6 |
| Time required for complete tarnish removal at 120° F | 5 secs. | 11 secs. | 4 secs. |

Tarnish removal by dihydroxy maleic acid takes place in acid or alkaline mediums. Typical pH ranges for tarnish removal using such formulations will vary from a pH of about 3.0 to 11.0.

In the experiments described in this example, the dihydroxy maleic acid level of compositions A, B and C was 16.0%. Thus the dihydroxy maleic acid concentration in a 0.3% use solution of any of the three compositions was 0.048%. While 16% is an effective and practical level of dihydroxy maleic acid in a tarnish removing composition, the instant invention is operative throughout a dihydroxy maleic acid level range of about 0.5% to about 100% in the composition. Thus the dihydroxy maleic acid present in a 0.3% use solution of compositions A, B or C could range from about 0.0015 to about 0.3%, respectively.

EXAMPLE 6

Six dinner plates were discolored to a deep brown stain by prolonged exposure in a 0.25% solution of automatic dishwasher detergent in manganese bearing tap water.

Three of the dishes were treated in a Hobart Automatic Dishwasher programmed for full cycle operation. Edgewater, New Jersey tap water at 135° F was used during the cycles. In place of detergent, the machine's dispenser cup was filled with 30 grams of the following composition:

| | % (weight) |
|---|---|
| Dihydroxy maleic acid | 20 |
| Sodium sulfate | 80 |
| Total | 100 |

Upon completion of the wash cycle program, it was observed that the brown hard surface discoloration had been completely removed.

The procedure was repeated with the remaining three discolored dinner plates, however, in place of the dihydroxy maleic acid composition, an equal weight of sodium sulfate was used. This time, upon completion of the dishwasher machine wash and rinse cycle program, it was observed that none of the discoloration had been removed. This example clearly illustrates the practical application of dihydroxy maleic acid as a manganese discoloration removing agent.

EXAMPLE 7

Composition B of Examle 5 is used to remove light brown manganese derived stains from a procelain bath tub.

Composition B is sprinkled on the stained areas of the tub and warm water is allowed to dampen the powder. After a contact time of approximately 5 minutes, the damp powder is wiped away with a sponge and the tub flushed with warm water to remove the stains.

EXAMPLE 8

The following formulas shown in Table E8 represent scouring powders with added manganese stain removing agents.

Table E8

| | Various Powdered Scouring Formulations* | | | | | | | | | | | |
|---|---|---|---|---|---|---|---|---|---|---|---|---|
| | D | E | F | G | H | I | J | K | L | M | N | O |
| Sodium alkylbenzene sulfonate | 2.0 | 2.0 | 2.0 | 2.0 | 2.0 | 2.0 | 2.0 | 2.0 | 2.5 | 2.5 | 2.5 | 2.5 |
| Trisodium phosphate | 3.0 | 3.0 | 3.0 | 3.0 | — | — | — | — | — | — | — | — |
| Soda ash | — | — | — | — | 5.0 | 5.0 | 5.0 | 5.0 | 5.5 | 5.5 | 5.5 | 5.5 |
| Abrasive** | 90.0 | 70.0 | 90.0 | 70.0 | 88.0 | 68.0 | 88.0 | 68.0 | 87.0 | 67.0 | 87.0 | 67.0 |
| Sodium salt of dihydroxy maleic acid | 5.0 | 25.0 | — | — | 5.0 | 25.0 | — | — | — | — | — | — |
| Sodium salt of dihydroxy tartaric acid | — | — | 5.0 | 25.0 | — | — | 5.0 | 25.0 | — | — | — | — |
| Dihydroxy maleic acid | — | — | — | — | — | — | — | — | 5.0 | 25.0 | — | — |
| Dihydroxy tartaric acid | — | — | — | — | — | — | — | — | — | — | 5.0 | 25.0 |
| | 100.0 | 100.0 | 100.0 | 100.0 | 100.0 | 100.0 | 100.0 | 100.0 | 100.0 | 100.0 | 100.0 | 100.0 |

*Components given as percent by weight of total composition.
**A variety of abrasives, well known in the art, may be employed. Typical examples are silica flour,calcite, dolomite, pumice, kaoline, etc.

The powders may also contain some additional but minor components such as colorants and perfume.

EXAMPLE 9

The following example illustrates liquid scouring compositions containing the hydroxy compounds. Compounds are indicated as percent by weight of the total composition.

| | P | Q | R | S |
|---|---|---|---|---|
| Dodecyl benzenesulfonic acid | 1.17 | 1.17 | 1.17 | 1.17 |
| Sodium hydroxide | 0.34 | 0.34 | 0.34 | 0.34 |
| Partially hydrogenated tallow fatty acid | 4.16 | 4.16 | 4.16 | 4.16 |
| Lauric diethanol amide | 6.14 | 6.14 | 6.14 | 6.14 |
| Tetrapotassium pyrophosphate | 14.10 | 14.10 | 14.10 | 14.10 |
| Abrasive* | 10.0 | 10.0 | 10.0 | 10.0 |
| Dihydroxy maleic acid sodium salt | 5.0 | 20.0 | — | — |
| Dihydroxy tartaric acid sodium salt | — | — | 5.0 | 20.0 |
| Water | 59.09 | 44.09 | 59.09 | 44.09 |
| | 100.00 | 100.00 | 100.00 | 100.00 |

*A variety of abrasives, well known in the art, may be employed. Typical examples are silica flour, calcite, dolomite, purmice, kaoline, etc.

It is to be further understood that in light of the instant specification that this invention is capable of variation and modification without departing from the scope thereof.

What is claimed is:

1. A method for removing manganese ion-derived discolorations from hard surfaces comprising:

treating said discolored hard surfaces, in the presence of water, with a sufficient amount to remove said discoloration of a hydroxy compound selected from the group consisting of dihydroxy maleic acid, dihydroxy tartaric acid, the alkali metal salts of said acids, and mixtures thereof.

2. A method for removing manganese ion-derived discolorations from hard surfaces comprising:

treating said discolored hard surfaces, in the presence of water, with a sufficient amount to remove said discoloration of a hard surface stain removing agent including a hydroxy compound selected from the group consisting of dihydroxy maleic acid, dihydroxy tartaric acid, the alkali metal salts of said acids, and mixtures thereof.

3. A method according to claim 2 wherein said treatment in the presence of water is accomplished by having said hard surface stain removing agent in the form of a liquid rinse agent consisting essentially of:

water and about 0.001% to about 16% of said hydroxy compound.

4. A method according to claim 2 wherein said hard surface stain removing agent is in the form of a powdered hard surface cleaning composition consisting essentially of:

said hydroxy compound; and a filler selected from the group consisting of sodium sulfate, sodium chloride, soda ash, sodium acetate, sodium diacetate and mixtures thereof.

5. A method according to claim 4 wherein said hydroxy compound is present in said composition at a level of about 0.5% to about 20%.

6. A method according to claim 2 wherein said hard surface stain removing agent is in the form of a scouring powder consisting essentially of:

said hydroxy compound; an abrasive; a surfactant selected from the group consisting of nonionic, anionic, cationic, amphoteric and zwitterionic surfactants and mixtures thereof; and a builder.

7. A method according to claim 6 wherein said hydroxy compound is present in said scouring powder at a level of about 1% to about 10%.

8. A method according to claim 7 wherein said abrasive is selected from the group consisting of silica, ground quartz, ground marble, calcite, dolomite, pumice stone and mixtures thereof, and wherein said surfactant is selected from the group consisting of alkylbenzene sulfonates, olefin sulfonates, hydroxy alkane sulfonates, alkane sulfonates and mixtures thereof and wherein said builder is selected from the group consisting of alkali metal orthophosphate, polyphosphates, sodium carbonate, citric acid, sodium citrate, carboxymethyloxysuccinate, carboxymethyloxytartronate and mixtures thereof.

9. A method according to claim 2 wherein said hard surface stain removing agent is in the form of a liquid scouring composition consisting essentially of:

said hydroxy compound, an abrasive, a surfactant selected from the group consisting of anionic surfactants, nonionic surfactants, alkali metal salts of fatty acids, ammonium salts of fatty acids and mixtures thereof; a builder; and water.

10. A method according to claim 9 wherein said hydroxy compound is present in said liquid scouring composition at a level of about 5% to about 20%.

11. A method according to claim 10 wherein said abrasive is selected from the group consisting of silica, ground quartz, ground marble, calcite, dolomite, pumice stone and mixtures thereof and wherein said surfactant is selected from the group consisting of alkyl sulfates, alkyl benzene sulfonates, ethoxylated alkylsulfonates, sulfonated ethoxylated alkyl phenols, sulfated fatty esters of acids or alcohols, α-olefin sulfonates, alkyl sulfosuccinates, N-methyltaurides, alkyl monoethanolamide, alkyl diethanolamides, glycerolamides, tris-(hydroxymethyl)-methylamides, amine oxides, sodium soaps, potassium soaps, lithium soaps, ammonium soaps and mixtures thereof.

12. A powdered hard surface stain removing composition for the removal of manganese ionderived discolorations from hard surfaces consisting of:

a. a hydroxy compound selected from the group consisting of dihydroxy maleic acid, dihydroxy tartaric acid, the alkali metal salts of said acids and mixtures thereof; and b. a filler selected from the group consisting of sodium sulfate, soda ash, sodium acetate and mixtures thereof;

wherein said hydroxy compound is present in said composition in an amount sufficient to remove said manganese ion-derived discolorations from said hard surfaces when said hard surface is treated with said composition in the presence of water.

13. A powdered hard surface stain removing composition in accordance with claim 12 wherein said hydroxy compound is present at a level of about 0.5% to about 20%.

14. A powdered hard surface stain removing composition in accordance with claim 12 wherein said hydroxy compound is present at a level of about 10% to about 18%.

15. A powdered hard surface stain removing composition in accordance with claim 12 wherein said compound is present at a level of about 16%.

16. A stain removing scouring powder composition for the removal of manganese ion-derived discolorations from hard surfaces consisting essentially of:

a. a hydroxy compound selected from the group consisting of dihydroxy maleic acid, dihydroxy tartaric acid, the alkali metal salts of said acids and mixtures thereof;

b. an abrasive selected from the group consisting of silica, ground quartz, ground marble, calcite, dolomite, pumice stone and mixtures thereof;

c. a surfactant selected from the group consisting of alkylbenzenesulfonates, olefin sulfonates, hydroxyalkane sulfonates, alkane sulfonates and mixtures thereof wherein said surfactant is present at a level of about 0.5% to about 15%, and d. a builder selected from the group consisting of alkali metal orthophosphates, polyphosphates, sodium carbonate, citric acid, sodium citrate, carboxymethyloxysuccinate, carboxymethyloxytartronate and mixtures thereof;

wherein said hydroxy compound is present in said composition in an amount sufficient to remove said manganese ion-derived discolorations from said hard surfaces when said hard surface is treated with said compositions in the presence of water.

17. A stain removing scouring powder composition according to claim 16 wherein said hydroxy compound is present at a level of about 1% to about 10%.

18. A stain removing scouring powder composition according to claim 17 wherein said surfactant is present in said composition at about 2.0% to about 2.5%, said builder is present in said composition at about 3.0% to about 6.0% and said hydroxy compound is present in said composition at a level of about 4.0% to about 8.0%.

19. A composition according to claim 18 wherein said hydroxy compound is present at a level of about 5%.

20. A stain removing liquid scouring composition for the removal of manganese ion-derived discolorations from hard surfaces consisting essentially of:

a. a hydroxy compound selected from the group consisting of a dihydroxytartaric acid, the alkali metal salts of said acid, dihydroxymaleic acid, and mixtures thereof.

b. an abrasive selected from the group consisting of silica, ground quartz, calcite, dolomite, ground marble, pumice stone and mixtures thereof;

c. a surfactant selected from the group consisting of alkyl sulfates, alkylbenzenesulfonates, ethoxylated alkylsulfonates, sulfonated ethoxylated alkylphenols, sulfated fatty esters of acids or alcohols, α-olefin sulfonates, alkyl sulfosuccinates, N-methyltaurides, alkyl monoethanolamides, glycerolamides, tris-(hydroxymethyl)-methylamides, amine oxides, sodium soaps, potassium soaps, lithium soaps, ammonium soaps and mixtures thereof wherein said surfactant is present at a level of about 0.5% to about 20%;

d. a builder selected from the group consisting of alkali metal orthophosphates, polyphosphates, sodium carbonate, citric acid, sodium citrate, carboxymethyloxysuccinate, carboxymethyloxytartronate and mixtures thereof;

wherein said hydroxy compound is present in said composition in an amount sufficient to remove said manganese ion-derived discolorations from said hard surfaces when said hard surface is treated with said composition.

21. A stain removing liquid scouring composition according to claim 20 wherein said hydroxy compound is present at a level of about 5% to about 20%.

22. A stain removing liquid scouring composition according to claim 21 wherein said hydroxy compound is present at a level of about 15% and wherein said surfactant is present at about 5% to about 15%.

23. A powdered hard surface stain removing composition consisting of:

a. a hydroxy compound selected from the group consisting of dihydroxy maleic acid, dihydroxy tartaric acid, the alkali metal salts of said acids and mixtures thereof;

b. a filler selected from the group consisting of sodium sulfate, soda ash, sodium acetate and mixtures thereof; and c. at least one ingredient selected from the group consisting of perfume and an optical brightener wherein said hydroxy compound is present in said composition in an amount sufficient to remove said manganese ion-derived discolorations from said hard surfaces when said hard surface is treated with said composition in the presence of water.

24. A stain removing liquid scouring composition for the removal of manganese ion-derived discolorations from hard surfaces consisting essentially of:

a. a hydroxy compound selected from the group consisting of dihydroxymaleic acid, the alkali metal salts of said acid and mixtures thereof;

b. an abrasive selected from the group consisting of silica, ground quartz, calcite, dolomite, ground marble, pumice stone and mixtures thereof;

c. a surfactant selected from the group consisting of alkyl sulfonates, alkylbenzenesulfonates, ethoxylated alkylsulfonates, sulfonated ethoxylated alkylphenols, sulfated fatty esters of acids or alcohols $\alpha$-olefin sulfonates, alkyl sulfosuccinates N-methyltaurides, alkyl monoethanolamides, glyceraolamides, tris-(hydroxymethyl)-methylamides, amine oxides, sodium soaps, potassium soaps, lithium soaps and mixtures thereof, wherein said surfactant is present at a level of about 0.5% to less than about 15%;

wherein said hydroxy compound is present in said composition in an amount sufficient to remove said manganese ion-derived discolorations from said hard surfaces when said hard surface is treated with said composition.

25. A stain removing liquid scouring composition according to claim 24 wherein said hydroxy compound is present at a level of about 5% to about 20%.

26. A stain removing liquid scouring composition according to claim 25 wherein said hydroxy compound is present at a level of about 15% and wherein said surfactant is present at a level of at least 5%.

* * * * *

UNITED STATES PATENT AND TRADEMARK OFFICE

CERTIFICATE OF CORRECTION

PATENT NO. : 4,049,467

DATED : September 20, 1977

INVENTOR(S) : Fred Kurt Rubin

It is certified that error appears in the above-identified patent and that said Letters Patent are hereby corrected as shown below:

Col. 1, line 50: change "N,N-dichlorop-toluene" to -- N,N-dichloro-p-toluene --.

Col. 1, line 52: change "in" to -- ion --.

Col. 2, line 30: change "U.s." TO -- U.S. --.

Col. 2, lines 42, 43: change "analogeous" to -- analogous --.

Col. 3, line 30: "an" should be -- and --.

Col. 3, line 37: "born" should be -- borne --.

Col. 4, line 1: change "be" to -- been --.

Col. 4, line 57: "a inert" should be -- an inert --.

Col. 5, line 23: "surry" should be -- slurry --.

Col. 5, line 23: change "referred" to -- preferred --.

Col. 8, line 48: change "strps" to -- strips --.

UNITED STATES PATENT AND TRADEMARK OFFICE

CERTIFICATE OF CORRECTION

PATENT NO. : 4,049,467

DATED : September 20, 1977

INVENTOR(S) : Fred Kurt Rubin

It is certified that error appears in the above-identified patent and that said Letters Patent are hereby corrected as shown below:

Col. 8, line 54: "discoloraton" should be -- discoloration --.

Claim 12, col. 15, line 18: change "ionderived" to -- ion-derived --.

Claim 24, col. 17, lines 12-13: "glyceraolamides" should be -- glycerolamides --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*